United States Patent [19]

Roche

[11] 3,955,607

[45] *May 11, 1976

[54] MITERING GUIDE FOR ROTARY POWER TOOL

[76] Inventor: Edward N. Roche, 5 Hickory Hill Road, Cockeysville, Md. 21030

[ * ] Notice: The portion of the term of this patent subsequent to Oct. 21, 1992, has been disclaimed.

[22] Filed: Mar. 3, 1975

[21] Appl. No.: 554,962

[52] U.S. Cl. ..... 144/134 D; 144/253 R; 90/12 D

[51] Int. Cl.[2] ..... B27C 5/10

[58] Field of Search ..... 51/170 PT; 90/12 D; 144/134 D, 134 E, 134 F, 136 C, 253 R

[56] References Cited

UNITED STATES PATENTS

| | | | |
|---|---|---|---|
| 2,705,032 | 3/1955 | Pearson | 144/134 D |
| 2,943,655 | 7/1960 | Pedersen | 144/134 D X |
| 3,212,541 | 10/1965 | Burrows | 144/134 D |
| 3,376,787 | 4/1968 | Morganson | 144/134 D X |

*Primary Examiner*—Al Lawrence Smith
*Assistant Examiner*—Gary L. Smith
*Attorney, Agent, or Firm*—John F. McClellan, Sr.

[57] ABSTRACT

A guide for a manual rotary power tool having an end-mill type rotary cutter for mitering high pressure laminate structure, including a plate with a guide strip beneath and a recess along the guide strip proximate the plate for receiving the edge of laminate sheet to be mitered; articulated bracket structure with an angled flange for holding a rotary power tool adjustably in the axial direction of the cutter with the cutter located tangent to either end of the guide strip and plate or at an intermediate position therebetween, the articulated bracket structure including portions movable relative to each other in a plane parallel to the plate and fixed in position by a shim arrangement for translatory adjustment of the cutter to accommodate different laminate thicknesses; co-acting radius-guide structure for mitering is also disclosed.

14 Claims, 10 Drawing Figures

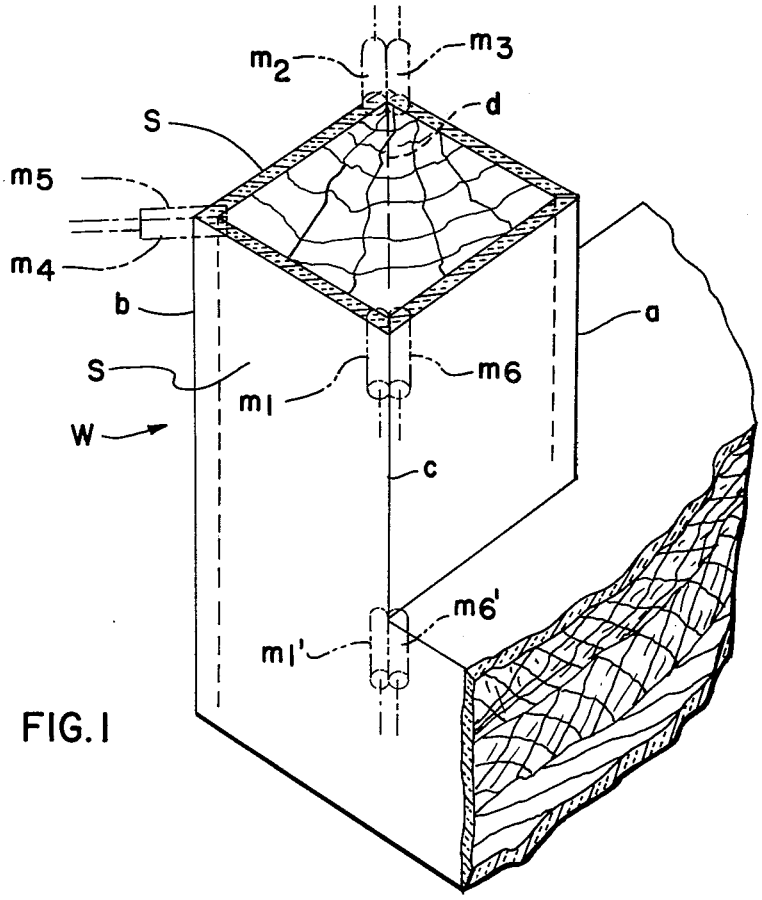
FIG. 1
FIG. 2
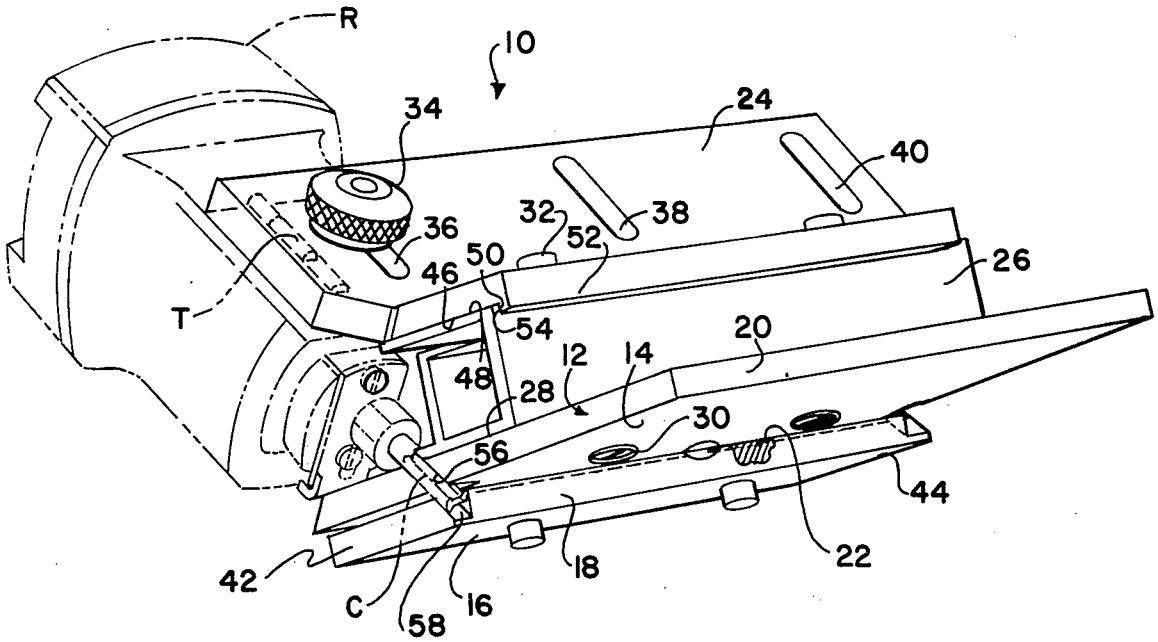

MITERING GUIDE FOR ROTARY POWER TOOL

Cross-reference is made to my co-pending application Ser. No. 513,121 filed Oct. 8, 1974, for Router Mitering Guide, the same having been copending with my application which matured into U.S. Pat. No. 3,841,369, granted Oct. 15, 1974 for Seamless Edge Lamination Apparatus.

This invention relates generally to manual rotary power tools and particularly to manual rotary power tool guide assemblies used in mitering high pressure laminates, such as "Formica" brand sheet affixed to substrate of plywood or the like.

A principal object of this invention is to provide a mitering guide assembly for manual rotary power tool use which replaces several separate guides now used in producing "seamless" joints by mitering.

A further object is to provide a guide as described which makes possible mitering of partially assembled furniture composed of high pressure laminate sheets covering plywood or other substrates after bonding thereto. In particular, in the prior art provision is made for mitering the edges of "L"-shaped sheet workpieces by my copending application, but insofar as is known no guide previously available has also provided fixed, predetermined cutter locations permitting mitering covering laminate at any corner of a Parsons type table leg except the interior corner.

Such provision makes possible faster, more precise, more economical and higher quality production of furniture of the Parsons type, for example, with all edge intersections of the covering laminate material appearing to be continuous, none of the high pressure laminate core showing to interrupt the surface coloration.

Other objects of the invention are to provide a guide which is adaptable to various tools, which is safe, rigid, easy to set and to change over, which gives good visibility where required, which miters radiused work when necessary, which works either left-handed or right-handed, and which is durable and economical.

In brief summary given for cursive descriptive purposes only, the guide includes a work engaging plate and a versatile guide mechanism recessed to receive a laminate edge, a bracket adapted for holding a power tool and adjusting it axially and in translation parallel to the plate in any of three predetermined locations: at either end of the plate with the outermost portion of the cutter periphery tangent to the end of the plate or at an intermediate position.

The above and other advantages and objects of the invention will become more readily apparent on examination of the following description, including the drawings in which like numerals indicate like parts:

FIG. 1 is an isometric view of a workpiece showing cutter positions;

FIG. 2 is an isometric view of the guide of this invention;

ONE OF THE PROBLEMS SOLVED BY THE INVENTION

Figure 3:
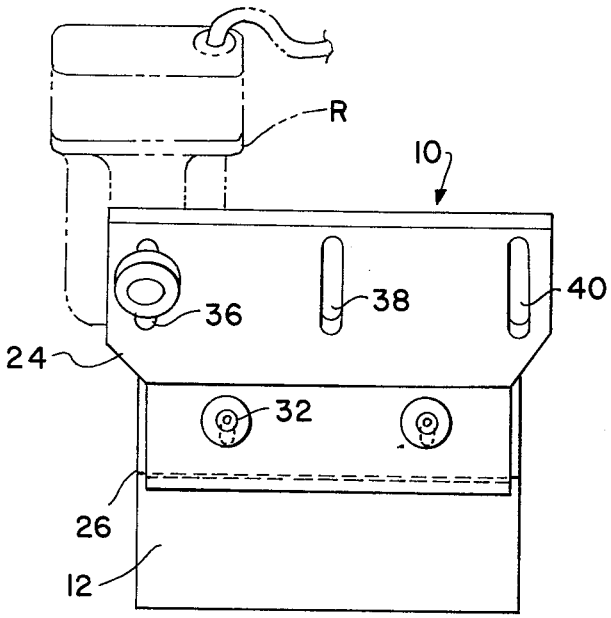
FIG. 3 is a top plan view.

FIG. 1 illustrates aspects of a problem solved by this invention.

Workpiece W represents a fragment of the top and a leg of an inverted Parsons type table covered high pressure laminate sheet S such as "Formica" brand sheet. Highest quality construction is indicated in that all edge intersections which show are tightly mitered to prevent substrate coloration from producing the familiar contrasting "banding" appearance.

Fitting the edge intersections is best accomplished by mitering in place the high pressure laminate covering sheet to the greatest extent feasible, since this at the same time combines greatest speed with most precise fit.

In the instance shown, the inner leg-covering sheets can be made oversize and bench-mitered to form edge intersection *a*, then clamped in place on the leg and mitered by cutter beginning at positions $m_1$ and $m_2$, using the guide of this invention and travelling downward. Similarly, when these pieces are removed, the covering sheets forming edge intersection *b* and completing edge intersections *c* and *d* can be one at a time temporarily clamped to the table substrate and mitered in place with the cutter working downward from respective positions $m_3$ and $m_4$ and $m_5$ and $m_6$. Finally, all pieces are coated with adhesive and clamped in place, fitting together.

It will be seen that when the cutter travels downward from position $m_6$ to position $m_6'$, for example, this is the same as mitering into an interior corner of a "L" shaped piece, since the cutter can continue around the corner and miter the remainder of the "L" in the manner described in my aforesaid disclosure.

However, using known prior art devices the cutter cannot proceed from position $m_1$ to position $m_1'$, resting in the normal manner on the flat surface of the sheet being mitered, because the guide structure interferes at the $m_1'$ position with the underside of the table. This applies no matter whether the underside of the table occupies a right-hand or a left hand position to the tool.

This is one of the problems the present invention solves, as will be seen.

THE INVENTION

FIG. 2 illustrates generally the right end and bottom details of the guide of the invention 10 and the relation to a typical manual rotary power tool R.

The guide comprises generally a rectangular plate 12 having a planar bottom 14, with a guide strip 16 screwed to it. The guide strip is coextensive with the plate and has an upright edge or guiding edge 18 facing toward and generally parallel with the forward edge 20 of the plate, providing at all times a visual indication of the orientation and extent of the guiding edge.

A recess 22 from end-to-end of the guiding edge proximate the plate receives the edge of a high pressure laminate sheet during mitering while the plate rests on the broad area of the high pressure laminate sheet and the guiding edge contacts the wood substrate on which the high pressure laminate sheet is clamped or bonded as the case may be.

An articulated bracket assembly comprising a first or angle bracket 24 and a second or rectangular-section bracket 26 adjustably affixes any suitable manual rotary power tool to the upper surface 28 of the plate by means of machine screws 30, bracket screws 32, and tool clamping screw 34 which passes through a slot 36, 38, 40 at one of three positions.

The first bracket is angled with respect to the plate in a fore-aft direction parallel with the intended alignment of the mitering cutter c, which is preferably of the elongate endmill type, having cutting flutes on the side as well as end. The slots 36, 40 so position the tool relative to either end of the guide that the outermost or endmost portion of the cutter periphery is tangent to the particular end 42, 44 of the guide proximate the cutter. The intermediate slot positions the tool intermediate the ends of the guide. Conventional means such as tongue and groove structure T prevent pivoting of the tool, and also permit the tool to be advanced and retracted along the slot for axial adjustment. For purposes which will be explained, the tool can be translated in a fore-and-aft direction parallel with the plate by loosening the bracket screws, permitting relative fore-and-aft motion between the complementary horizontal clamping surfaces 46 and 48 of the first bracket and the second bracket, which also have complementary shim-surfaces for setting this relation, when a shim is placed therebetween.

The second bracket has an upright face 50 which serves as a shim-face and the first bracket has an overhang 52 over the first bracket with a shim-face 54 on the inner side of the overhang opposing the second bracket shim face.

Apertures 56, 58 in the plate and guide strip respectively, provide for passage of the cutter obliquely therethrough and into the guide strip recess.

It can be seen that the forward extent of the plate can be much less than shown, if desired, because of the compact attachment provided by the upright design of the second bracket.

FIG. 3 illustrates in top plan view the general relation of the guide 10 with the tool R at the same right-end location shown in FIG. 1. The good cutter visibility provided by narrowing the first bracket 24 to meet the length of the second bracket 26 is readily apparent, as is the relation of the shim faces (dotted line) and the positioning of the slots 36, 38, 40, bracket screws 32, second bracket 26 and plate 12. It can be seen that the tool can be instantly repositioned by removal of the knurled screw and replacement in another slot to hold the tool in the new location desired.

Figure 4:
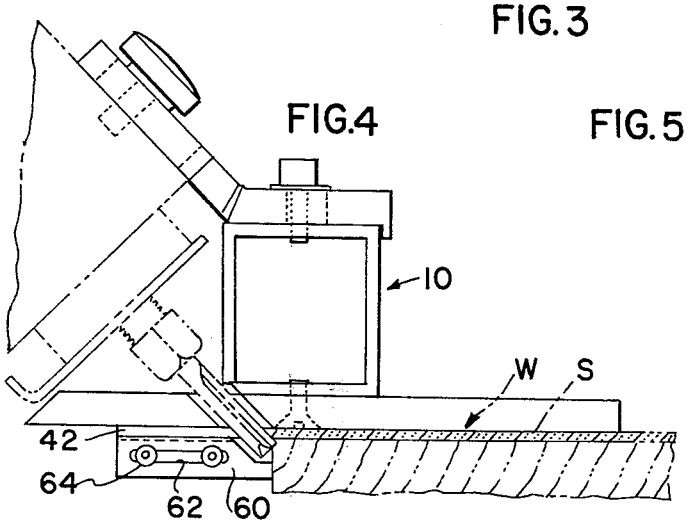
FIG. 4 is a right end elevation detail.

FIG. 4 shows that the rear edge of the plate is beveled to receive and locate a projection of the tool, speeding relocation axially.

Figure 5:
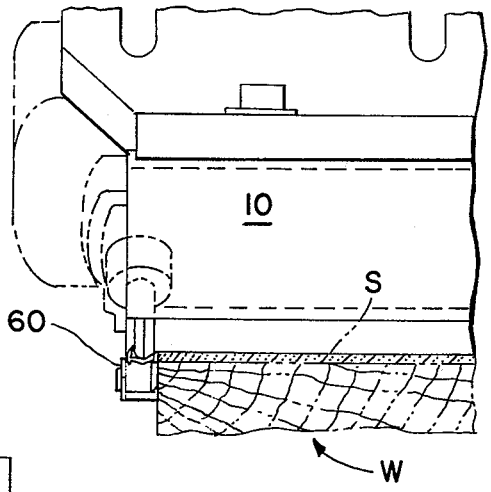
FIG. 5 is a front elevation detail.

FIG. 4 and FIG. 5 illustrate the relation of the work W, the high pressure laminate S on the wood substrate, to the invention 10 during mitering operations. Also illustrated is an optional co-acting radius guide 60 for producing curved mitered edges. The radius guide is in the form of an elongated rectangular member with a longitudinal slot 62 engaged by two screws 64 held in tapped holes in the end 42 of the guide strip, or it may be otherwise suitably held.

The radius guide is held at the level of the guide strip with the top thereof at the bottom of the guide strip recess, and is positionable to extend forwardly beyond the guide strip for radius mitering operations.

Figure 6:
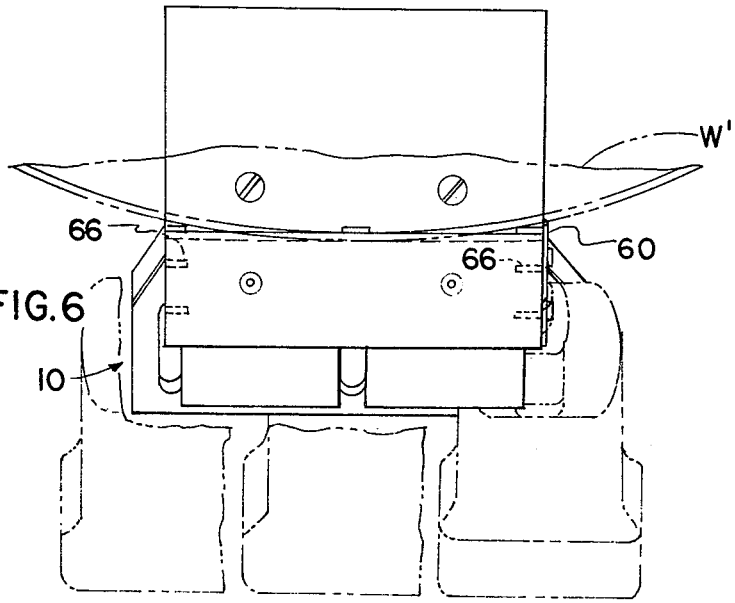
FIG. 6 is a bottom plan detail.

FIG. 6 shows in bottom plan view the relation of the guide strip in extended position to circular or otherwise radiused work W′ being mitered. As indicated by the tapped holes 66, the guide strip can be mounted on either end of the guide 10. As illustrated, the work being mitered contacts the guide strip at one place and the radius guide at the other end, and the tool and cutter can be in any of the three positions predetermined by the slots, (phantom lines).

Figure 7:
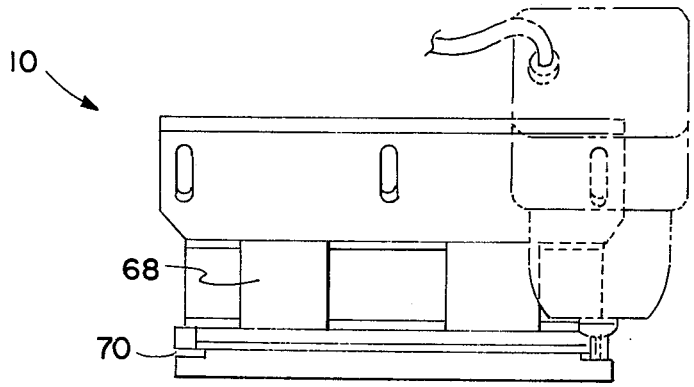
FIG. 7 is a rear elevation detail.

FIG. 7 is a rear elevation showing the rear supports 68 between the cutouts at the three tool positions, imparting rigidity to the second bracket, required to prevent flexing and imprecise mitering. Also shown are the recesses 70 in the ends of the guide strip permitting close work in "L" shaped corners.

Figure 8:
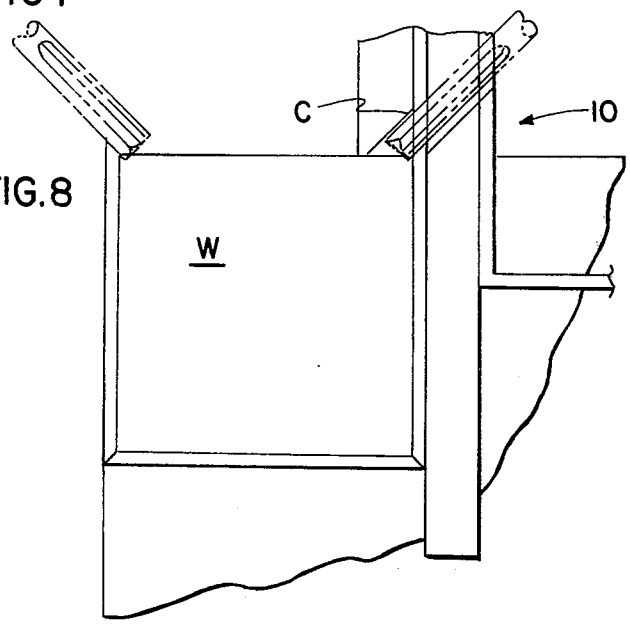
FIG. 8 is a right end elevation detail of a portion of the invention mitering a workpiece.

FIG. 8 shows a detail of the invention at work mitering table leg work W. The cutter may be in the intermediate position at the start and may be shifted to the far end or left hand position to complete the work.

Figure 9:
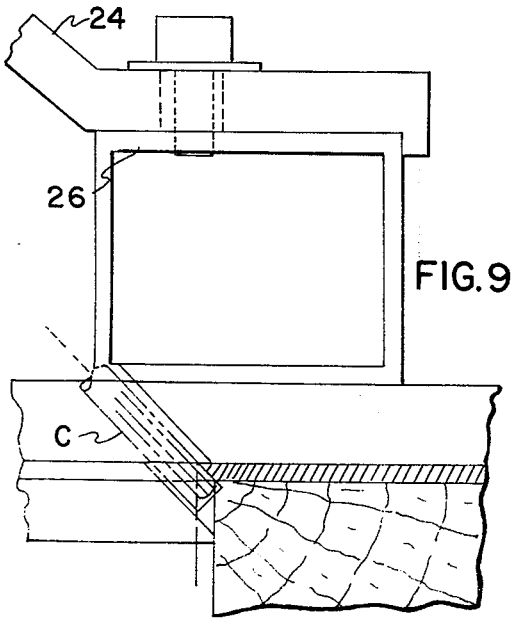
FIGS. 9 and 10 show in right end elevation detail two adjustment settings.
Figure 10:
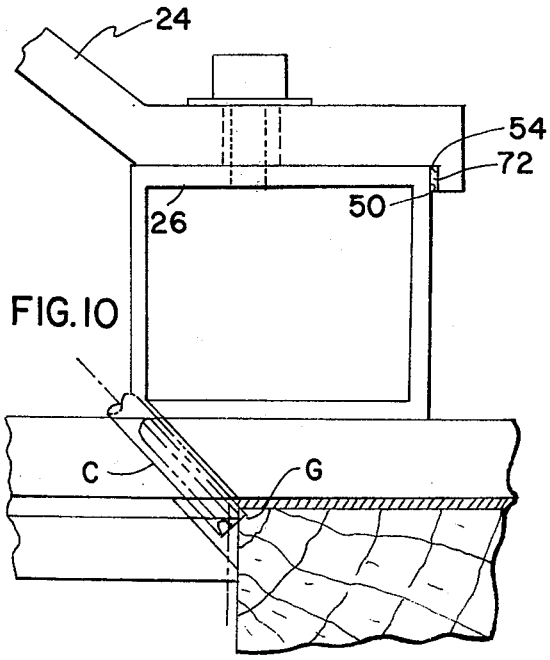

FIGS. 9 and 10 show the means of adjusting for mitering thinner work, by shimming. Inserting a long, (preferably coextensive) proper-thickness shim 72 between the shim faces 50, 54 of the first and second brackets 24, 26 moves the cutter toward the work the exact distance to the thousandth of an inch required to compensate for a particular high pressure laminate sheet thickness less-thick than the maximum the invention is designed to miter. Such direct and quick setting to exact dimension is most important in preventing spoiled work and in producing highest quality mitering, especially when using semi-skilled workers. The shim is readily inspected.

The overhanging design shields the shim surfaces and makes shim removal and insertion easy. It will be seen that the cutter automatically produces a desirable glue-groove G in the wood substrate, giving any excess glue squeezed out of the miter joint on assembly a place to go, further increasing the quality of the product which might otherwise tend to bulge open slightly at the edge intersections.

Obviously many modifications and variations of the present invention are possible in light of the above teachings. It is, therefore, to be understood that within the scope of the appended claims the invention may be practiced otherwise than as specifically described. What is claimed and desired to be secured by United States Letters Patent is:

1. A guide for a rotary power tool having an endmill type elongate cutter for mitering a laminate disposed on a substrate, comprising: a plate having top and bottom surfaces and left, right, front and rear edges, a guide strip rearwardly disposed on the bottom of said plate and having a guiding edge facing said front edge with a coextensive recess in the guiding edge proximate the bottom of said plate for receiving laminate therebetween while guiding on said a substrate, and means for holding said a rotary power tool at an angle to said plate and guide strip with the cutter passing downwardly and forwardly through said recess, including means for adjustably positioning said cutter at respective predetermined locations tangent with either end of said plate and guide strip and intermediately between said ends.

2. A guide as recited in claim 1, wherein the means for adjustably positioning said a rotary power tool includes means for adjustably fixing the axial position of said cutter relative to the recess.

3. A guide as recited in claim 2, wherein the means for adjustably fixing the axial position of said cutter relative to the recess includes a first bracket having a surface at the same angle relative to the plate as the desired cutter angle relative to the plate, and means in the first bracket for slidably receiving and clamping a portion of said a rotary power tool against said surface at each of said respective predetermined locations.

4. A guide as recited in claim 3, wherein the means for adjustably positioning said a rotary power tool further includes means for adjustably fixing the translatory position of said a rotary power tool in a direction perpendicular to said guiding edge and parallel to the bottom surface of said plate, for thereby adjusting for mitering different laminate thicknesses.

5. A guide as recited in claim 4, wherein the means for adjustably affixing the translatory position includes a second bracket adjustably mounting the first bracket to the plate.

6. A guide as recited in claim 5, wherein the first and the second bracket have respective clamping surfaces in substantially parallel-spaced relation with the bottom surface of the plate, with means for releasably clamping together said clamping surfaces; and wherein the first and the second brackets have respective shimming surfaces at an angle to said clamping surfaces, with means for adjustably spacing said shimming surfaces.

7. A guide as recited in claim 6, wherein the second bracket shimming surface is upright on a front portion thereof, wherein the first bracket has a downward flange overhanging the second bracket shimming surface with the shimming surface of the first bracket on the inner portion of the overhanging flange.

8. A guide as recited in claim 7, wherein the means for spacing the shimming surfaces apart comprises an elongate shim substantially coextensive with said shimming surfaces.

9. A guide as recited in claim 7, wherein the means for clamping said clamping surfaces includes a plurality of slots in the first bracket and a plurality of screws in the second bracket passing through said slots and engaging the first bracket.

10. A guide as recited in claim 9, wherein said plate and said guide strip have respective co-aligned apertures therein at each of said predetermined locations for passage of the cutter therethrough.

11. A guide as recited in claim 10, wherein the rear edge of the plate has a chamfer proximate each of said predetermined positions for engaging a portion of said a cutter.

12. A guide as recited in claim 1, wherein a radius-guide is provided, and wherein each end of the guide has means for attachment of said radius-guide, said radius-guide comprisising an elongate member, the means for attachment holding the elongate member parallel against an end of the plate with the forward portion of thereof at the level of said guiding edge, contiguous with the lower portion of said recess; the means for attachment adjustably positionable for holding said forward portion of the elongate member beyond the guiding edge when radius-guiding is required and for holding said forward portion of the elongate member in a rearward position when radius-guiding is not required.

13. A guide as recited in claim 12, wherein the means for attaching includes a pair of tapped holes in each end of the plate, and wherein the radius-guide has a slot therein located for engagement by screws in said tapped holes.

14. A guide as recited in claim 1, said guide strip having a recess at each end thereof communicating with the first said recess.

* * * * *